US009816523B2

(12) United States Patent
Kiriaki

(10) Patent No.: US 9,816,523 B2
(45) Date of Patent: Nov. 14, 2017

(54) CENTRIFUGAL COMPRESSOR

(71) Applicant: IHI Corporation, Koto-ku (JP)

(72) Inventor: Takuro Kiriaki, Tokyo (JP)

(73) Assignee: IHI Corporation, Koto-ku (JP)

( * ) Notice: Subject to any disclaimer, the term of this patent is extended or adjusted under 35 U.S.C. 154(b) by 910 days.

(21) Appl. No.: 14/141,524

(22) Filed: Dec. 27, 2013

(65) Prior Publication Data

US 2014/0105736 A1 Apr. 17, 2014

Related U.S. Application Data

(63) Continuation of application No. PCT/JP2012/065855, filed on Jun. 21, 2012.

(30) Foreign Application Priority Data

Jul. 13, 2011 (JP) ..... 2011-154973

(51) Int. Cl.

| | |
|---|---|
| ***F04D 29/42*** | (2006.01) |
| ***F04D 29/44*** | (2006.01) |
| ***F04D 29/66*** | (2006.01) |
| ***F04D 17/10*** | (2006.01) |

(52) U.S. Cl.

CPC ..... *F04D 29/4213* (2013.01); *F04D 17/10* (2013.01); *F04D 29/441* (2013.01); *F04D 29/665* (2013.01); *F05D 2250/51* (2013.01)

(58) Field of Classification Search

CPC .. F04D 29/4213; F04D 29/441; F04D 29/665; F04D 29/66; F04D 29/547; F04D 29/545; F04D 5/007; F04D 17/10; F05D 2250/51; F01D 9/023; F01D 25/14; F01D 25/24; F01D 25/30; F01D 25/026; F02C 7/04

See application file for complete search history.

(56) References Cited

U.S. PATENT DOCUMENTS

| | | | |
|---|---|---|---|
| 4,475,868 | A | 10/1984 | Renger |
| 2010/0143095 | A1 | 6/2010 | Higashimori et al. |

FOREIGN PATENT DOCUMENTS

| | | | |
|---|---|---|---|
| CH | 667 136 | A5 | 9/1988 |
| JP | 44-28070 | Y1 | 11/1969 |
| JP | 49-4038 | A | 1/1974 |
| JP | 58-104390 | A | 6/1983 |

(Continued)

OTHER PUBLICATIONS

Translation of CN 667136 A5 submitted with IDS filed Dec. 27, 2013.*

(Continued)

*Primary Examiner* — Gregory Anderson
*Assistant Examiner* — Danielle M Christensen
(74) *Attorney, Agent, or Firm* — Oblon, McClelland, Maier & Neustadt, L.L.P.

(57) ABSTRACT

A centrifugal compressor includes an expanded section which forms a cylindrical space between a suction opening and an impeller. An inlet tapered section is formed on an inlet side of the expanded section, and an outlet tapered section is formed on an outlet side of the expanded section. The expanded section has an inner diameter which is larger than an inner diameter of the suction opening and at least twice as large as an inlet diameter of the impeller.

16 Claims, 4 Drawing Sheets

(56) References Cited

FOREIGN PATENT DOCUMENTS

| | | | |
|---|---|---|---|
| JP | 5-113199 | A | 5/1993 |
| JP | 9-310699 | A | 12/1997 |
| JP | 2003-519329 | A | 6/2003 |
| JP | 2004-027931 | A | 1/2004 |
| JP | 2009-191635 | A | 8/2009 |
| JP | 2009-209694 | A | 9/2009 |

OTHER PUBLICATIONS

International Search Report dated Sep. 4, 2012 for PCT/JP2012/065855 filed Jun. 21, 2012 with English Translation.
International Written Opinion dated Sep. 4, 2012 for PCT/JP2012/065855 filed Jun. 21, 2012.
German Office Action issued Jun. 2, 2016 in Patent Application No. 11 2012 002 923.2.

* cited by examiner

CENTRIFUGAL COMPRESSOR

CROSS REFERENCE TO RELATED APPLICATIONS

This application is a continuation application of International Application No. PCT/JP2012/065855, filed on Jun. 21, 2012, which claims priority to Japanese Patent Application No. 2011-154973, filed on Jul. 13, 2011, the entire contents of which are incorporated by references herein.

BACKGROUND OF THE INVENTION

1. Field of the Invention

The present invention relates to a centrifugal compressor which is configured to compress a gas such as air with centrifugal force, and is used for a turbocharger, a gas turbine, an industrial pneumatic system and the like.

2. Description of the Related Art

Brief descriptions will be provided for a configuration of a general centrifugal compressor used for a turbocharger such as a vehicle turbocharger.

The general centrifugal compressor includes a housing. The housing has a shroud (wall surface) in its inside. In addition, an impeller is rotatably provided inside the shroud of the housing in such a manner as to be rotatable about the axis of the impeller. The impeller includes: a disc (hub disc) rotatable about the axis of the impeller; and multiple blades provided at intervals on the outer peripheral surface of the disc.

A suction opening is formed in the outer wall of the housing. The suction opening is situated on the inlet side of the impeller, and sucks air as an example of a gas. In addition, an air discharging passage is formed in the housing. The air discharging passage is provided on the outlet side of the impeller, and discharges the compressed air. Furthermore, a discharge opening is formed in an appropriate position on the outer wall of the housing. The discharge opening communicates with the air discharging passage. The compressed air passes through the air discharging passage and is discharged from the discharge opening.

The impeller rotates when the centrifugal compressor is operated. The rotation makes it possible to compress the air, which is sucked from the suction opening into the impeller, by using centrifugal force and to discharge the compressed air from the discharge opening to the outside of the housing via the air discharging passage.

Incidentally, Japanese Patent Application Laid-Open Publication Nos. 2009-09694, 2004-27931 and H09-310699 disclose conventional techniques related to the present invention.

SUMMARY OF THE INVENTION

In recent years, there has been an increasing demand to expand an operational range of a centrifugal compressor toward its lower flow rate side with suppressing a surge in the centrifugal compressor.

With this taken into consideration, an object of the present invention is to provide a centrifugal compressor capable of expanding an operational range toward its low flow rate side.

A first aspect of the present invention provides a centrifugal compressor configured to compress a gas with centrifugal force, which includes: a housing; an impeller rotatably provided in the housing and having a disc rotatable about an axis of the impeller, and multiple blades provided on an outer peripheral surface of the disc at intervals in a circumferential direction of the disc; a suction opening formed on an inlet side of the impeller and configured to suck the gas; and an expanded section formed between the suction opening and the impeller, and defining a cylindrical space. Here, the expanded section has an inner diameter which is larger than an inner diameter of the suction opening and at least twice as large as an inlet diameter of the impeller.

In the specification and scope of claims of this application, the "gas" is a notion including air, nitrogen gas, hydrogen gas and the like. In addition, the "axis" means the axis of the impeller; the "axial direction" means the axial direction of the impeller; and the "radial direction" means the radial direction of the impeller. Furthermore, the "upstream" means upstream viewed in the direction of a flow of the mainstream gas and the "downstream" means downstream viewed in the direction of the flow of the mainstream gas.

A ratio of a distance from a front edge of each blade to the expanded section in the axial direction to an axial length of the blade may be in a range of 1.0 to 6.0.

Here, in the specification and scope of claims of this application, the "axial length of the blade" means the length from a tip end (extremity) of a front edge of the blade to a hub end (base end) of a rear edge of the blade. In the case where multiple types of blades with different axial lengths are provided, then the axial length means the axial length of the longest blade.

A ratio of an axial length of the expanded section to an axial length of each blade may be in a range of 0.5 to 5.0.

According to the present invention, it is possible to inhibit the backward flow region located upstream of the impeller in the vicinity of the surge chamber from expanding in the upstream direction. Accordingly, it is possible to expand the operational range of the centrifugal compressor toward its lower flow rate side with sufficiently suppressing the surge in the centrifugal compressor.

BRIEF DESCRIPTION OF THE DRAWINGS

FIG. 1A shows a case where an expanded section defining a cylindrical space is not formed between a suction opening and the impeller. FIG. 1B shows a case where the expanded section is formed in between.

DESCRIPTION OF THE PREFERRED EMBODIMENTS

Figure 1A:
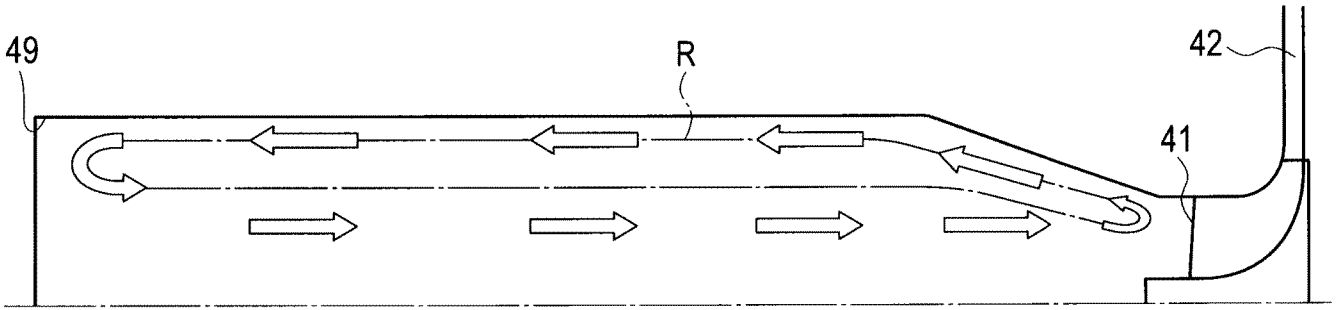
FIGS. 1A and 1B are diagrams showing a backward flow region located upstream of an impeller in the vicinity of a surge chamber.
Figure 1B:
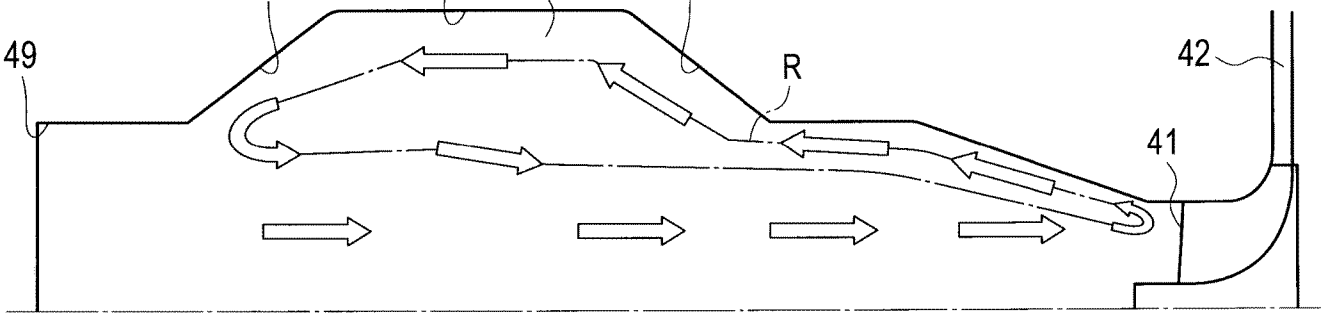

First of all, descriptions will be made for new knowledge obtained for the purpose of expanding an operational range of a centrifugal compressor toward its low flow rate side. FIG. 1A and FIG. 1B are diagrams showing a backward flow region R located upstream of an impeller 41 in the vicinity of a surge chamber. FIG. 1A shows a case where an expanded section 43 that defines a cylindrical (annular) space S is not formed between a suction opening 49 and the impeller 41, while FIG. 1B shows a case where the expanded section 43 is formed in between. The backward flow region R in each of FIG. 1A and FIG. 1B is obtained from pressure distribution which is analyzed by a three-dimensional steady viscosity CFD (Computational Fluid Dynamics) method.

As a result of the analysis, there is obtained knowledge that, when an expanded section with an appropriate inner diameter is formed between the suction opening and the impeller, the pressure of a space near a wall surface inside the expanded section 43 is increased, and this increase can inhibit the backward flow region located upstream of the impeller in the vicinity of the surge chamber from expanding in the upstream direction as compared with the case of not forming the expanded section (see FIG. 1A). One conceivable reason for this outcome is attributed to the space S near the wall surface of the expanded section 43, which serves as a so-called damper to receive pressure energy of a backward flow. Here, the appropriate inner diameter mentioned above means a diameter which is larger than an inner diameter of the suction opening 49 and at least twice as large as an inlet diameter of the impeller 41. Furthermore, an inlet tapered section 45 is formed on an inlet side (i.e., an upstream side) of the expanded section 43, while an outlet tapered section 47 is formed on an outlet side (i.e., a downstream side) of the expanded section 43. The inlet tapered section 45 has an inner diameter which became gradually smaller toward its upstream end, while the outlet tapered section 47 has an inner diameter which became gradually smaller toward its downstream end. In addition, a diffuser passage 42 through which to discharge air compressed by the impeller 41 is formed on an outlet side of the impeller 41.

First Embodiment

Figure 2:
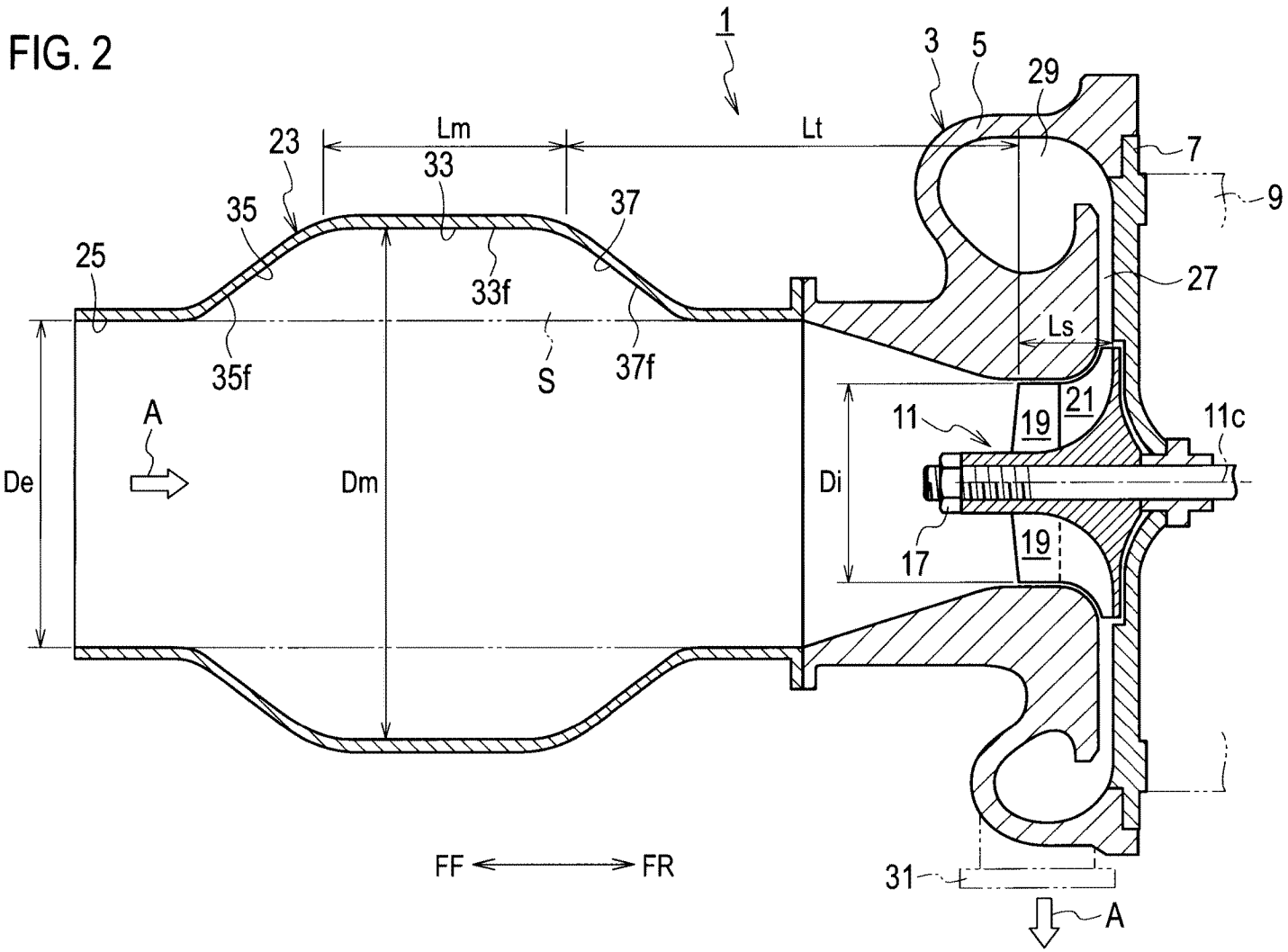
FIG. 2 is a cross-sectional view of a centrifugal compressor of a first embodiment of the present invention.
Figure 3:
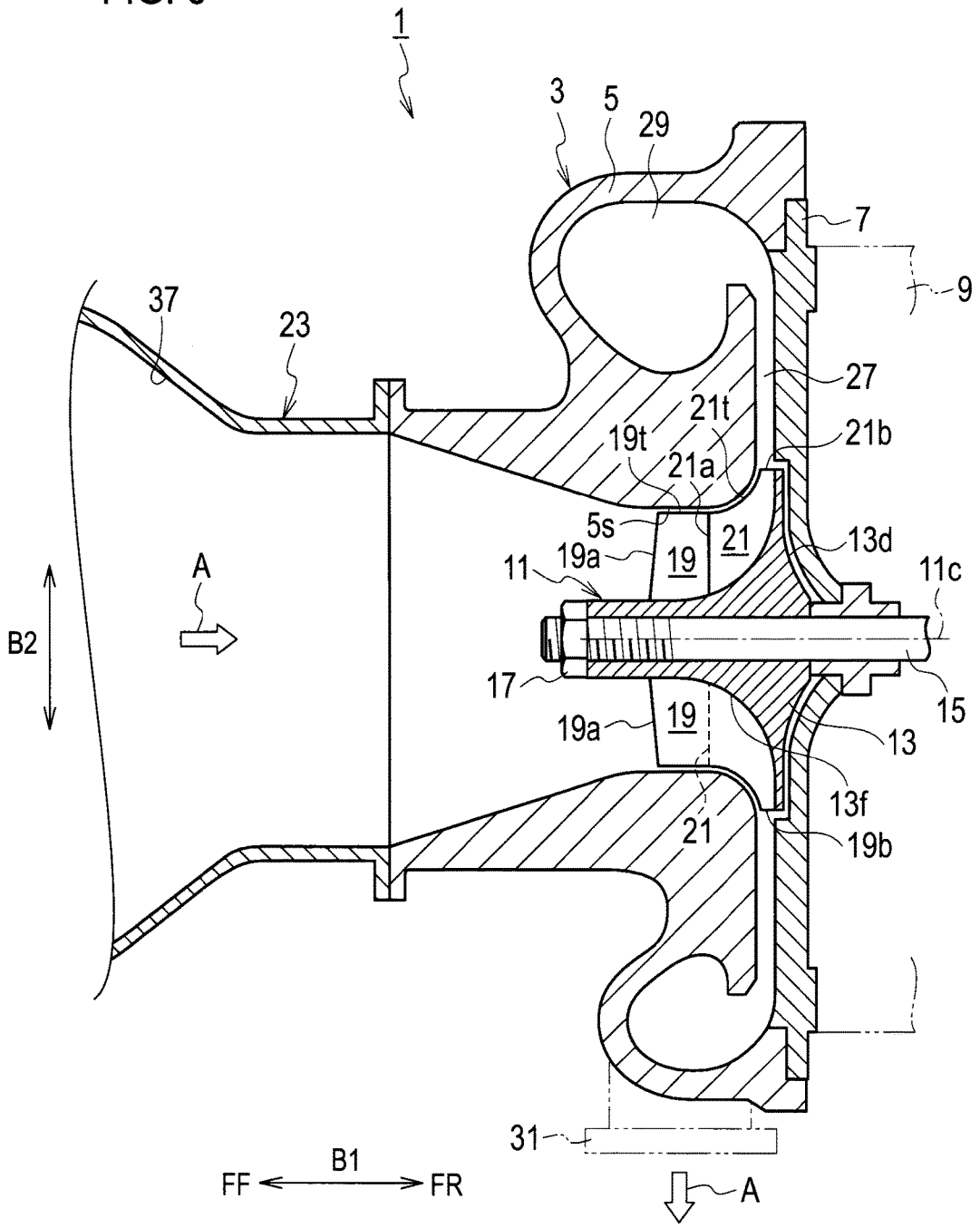
FIG. 3 is a magnified cross-sectional view of a part of the centrifugal compressor of the first embodiment of the present invention.

Descriptions will be provided for a first embodiment of the present invention while referring to FIG. 2 and FIG. 3. In the drawings, reference signs "FF", "FR", "B1", and "B2" indicate a forward direction, a rearward direction, an axial direction of an impeller, and a radial direction of the impeller, respectively.

As shown in FIG. 2 and FIG. 3, a centrifugal compressor 1 of the first embodiment of the present invention is configured to compress air (an example of a gas) A with centrifugal force. The centrifugal compressor 1 is used for a vehicle turbocharger, a gas turbine, and an industrial pneumatic system, for example.

The centrifugal compressor 1 includes a housing 3. The housing 3 includes: a housing main body 5 having a shroud (inner wall) 5*s* in its inside; and a seal plate 7 provided on a rear side of the housing main body 5. The seal plate 7 is integrally connected to a housing 9 of a turbocharger.

An impeller 11 is rotatably provided inside the shroud 5*s* of the housing main body 5. The impeller 11 includes a disc (hub disc) 13, full blades 19 and splitter blades 21.

To put it specifically, the disc (hub disc) 13 is provided inside the shroud 5*s* of the housing main body 5. The disc 13 is provided rotatable about an axis 11*c* of the impeller 11. The disc 13 is connected to an end portion of a rotor shaft (turbine shaft) 15 by use of a fixation nut 17. The rotor shaft 15 is rotatably provided to the housing 9, and rotates together with the disc 13. The disc 13 includes an outer peripheral surface (hub surface) 13*f*, and a back surface 13*d* opposed to the seal plate 7. The outer peripheral surface 13*f* extends in a curved manner from the axial direction B1 to the radial directions B2 of the impeller 11. Here, the rotor shaft 15 is rotated by rotational force transmitted from another impeller (not shown) connected to the other end of the rotor shaft 15.

The blades 19 and the blades 21 are provided on the outer peripheral surface 13*f* of the disc 13. The axial length of each blade 19 is different from that of each blade 21. The blades 19 are so-called full blades, while the blades 21 are so-called splitter blades. The blades 19 and the blades 21 are alternately arranged at intervals in the circumferential direction. In other words, each blade 21 is placed between the corresponding two adjacent blades 19, while each blade 19 is similarly placed between the corresponding two adjacent blades 21. A front edge 19*a* of each blade 19 is placed further upstream (forward) than a front edge 21*a* of each blade 21. On the other hand, a rear edge 19*b* of each blade 19 and a rear edge 21*b* of each blade 21 are placed in the same position in the axial direction B1 and in the radial direction B2. Moreover, an end 19*t* of each blade 19 in the radial direction extends along the shroud 5*s* of the housing main body 5. Similarly, an end 21*t* of each blade 21 in the radial direction extends along the shroud 5*s*. It should be noted that blades (not shown) having the same axial lengths may be used instead of the blades 19, 21 having the different axial lengths.

A cylindrical casing 23 is provided, upstream of the inlet of the impeller 11, to the outer wall of the housing main body 5 in a way that the casing 23 communicates with the inlet of the impeller 11. The casing 23 has a suction opening 25 through which to suck the air A on its front end side (the left side in FIG. 2). The suction opening 25 can be connected to an air cleaner (not shown), which is configured to clean the air, via a pipe (not shown).

A diffuser passage 27 as an air discharging passage is formed in the housing main body 5 (housing 3) on the outlet side (immediately downstream side) of the impeller 11. Furthermore, a scroll passage 29 is formed on an outer peripheral side of an outer periphery of the diffuser passage 27. The diffuser passage 27 is shaped like a ring, and discharges the compressed air while reducing the speed of the air. The scroll passage 29 is shaped like a scroll, and communicates with the diffuser passage 27. A discharge opening 31 is formed in the outer wall of the housing main body 5. The discharge opening 31 is formed in a way that makes the discharge opening 31 communicate with the scroll passage 29 and the diffuser passage 27, and is configured to discharge the air. The discharge opening 31 can be connected to an intake manifold (not shown) of an internal combustion engine via a pipe (not shown).

The following descriptions will be provided for a main part of the first embodiment of the present invention.

As shown in FIG. 2, an expanded section 33 is formed in the center of the casing 23. In other words, the expanded section 33 is formed between the suction opening 25 and the impeller 11. The expanded section 33 at least includes a cylindrical (annular) wall surface 33*f*, and forms a cylindrical (annular) space S. To put it specifically, the vicinity of the wall surface 33*f* of the expanded section 33 (including the vicinity of a wall surface 35*f* of an inlet tapered section 35 and the vicinity of a wall surface 37*f* of an outlet tapered section 37) forms the space S with an inner diameter which is equal to an inner diameter De of the suction opening 25. The inlet tapered section 35 is formed on an inlet side of the expanded section 33 in the casing 23. The inlet tapered section 35 is formed continuous to the expanded section 33. The inner diameter of the inlet tapered section 35 becomes gradually smaller toward its upstream (front) end. The outlet tapered section 37 is formed on an outlet side of the expanded section 33 in the casing 23. The outlet tapered section 37 is formed continuous to the expanded section 33. The inner diameter of the outlet tapered section 37 becomes gradually smaller toward its downstream (rear) end.

An inner diameter Dm of the expanded section 33 is set at a value which is larger than the inner diameter De of the suction opening 25 and 2.0 to 4.0 times as large as an inlet diameter Di of the impeller 11. The inner diameter Dm is set as described above in order to apply the novel knowledge described above. On the other hand, the reason why the inner diameter Dm is not greater than four times the inlet diameter Di of the impeller 11 is that when the inner diameter Dm is set at a value greater than four times the inner diameter D1, the centrifugal compressor 1 becomes larger in size, and it is difficult to realize the compact centrifugal compressor 1.

When reference sign Ls denotes the axial length of each blade 19 and reference sign Lt denotes the distance from the front edge 19*a* of each blade 19 to the expanded section 33 in the axial direction B1 of the impeller 11, a ratio (Lt/Ls) of the distance Lt to the axial length Ls is set in a range of 1.0 to 6.0, or preferably in a range of 1.5 to 4.0. The reason why the ratio (Lt/Ls) is set at a value not less than 1.0 is that when the ratio (Lt/Ls) is set at a value less than 1.0, the distance between the impeller 11 and the expanded section 33 becomes too short and the performance of the centrifugal compressor 1 is considerably deteriorated. On the other hand, the reason why the ratio (Lt/Ls) is set at a value not greater than 6.0 is that when the ratio (Lt/Ls) is set at a value greater than 6.0, the distance between the impeller 11 and the expanded section 33 becomes too large and it is difficult to realize the compact centrifugal compressor 1.

A ratio (Lm/Ls) of an axial length Lm of the expanded section 33 to the axial length Ls of each blade 19 is set in a range of 0.5 to 5.0, or preferably in a range of 0.5 to 2.5. The reason why the ratio (Lm/Ls) is set at a value not less than 0.5 is that when the ratio (Lm/Ls) is set at a value less than 0.5, the axial length Lm of the expanded section 33 becomes too short and it is difficult for the space S to perform the so-called damper function to receive the pressure energy of the backward flow. On the other hand, the reason why the ratio (Lm/Ls) is set at a value not greater than 5.0 is that when the ratio (Lm/Ls) is set at a value greater than 5.0, the centrifugal compressor 1 becomes larger in size and it is difficult to realize the compact centrifugal compressor 1.

Descriptions will be hereinbelow provided for the working and effects of the first embodiment of the present invention.

The rotational force of the other impeller rotates the rotor shaft 15, and the impeller 11 rotates together with the rotor shaft 15. Due to the rotation of the impeller 11, the air A is sucked from the suction opening 25 to the impeller 11, and centrifugal force is thus applied to the air A. Consequently, the air A can be compressed. Furthermore, the compressed air A can be discharged from the discharge opening 31 to the outside of the housing 3 via the diffuser passage 27 and the scroll passage 29.

In addition, the expanded section 33 in the shape of the cylindrical space is formed between the suction opening 25 and the impeller 11. The inner diameter Dm of the expanded section 33 is larger than the inner diameter De of the suction opening 25, and is at least twice as large as the inner diameter Di of the impeller 11. For this reason, as understood from the novel knowledge mentioned above, it is possible to inhibit the backward flow region located upstream of the impeller 11 in the vicinity of the surge chamber from expanding in the upstream direction.

Accordingly, the first embodiment of the present invention is capable of sufficiently suppressing the surge in the centrifugal compressor 1, and of expanding the operational range of the centrifugal compress 1 toward its lower flow rate side. Particularly, since the ratio (Lt/Ls) of the distance Lt to the axial length Ls is set in the range of 1.0 to 6.0 and the ratio (Lm/Ls) of the axial length Lm to the axial length Ls is set in the range of 0.5 to5.5, the first embodiment is capable of suppressing an increase in size of the centrifugal compressor 1, and of realizing the compact centrifugal compressor 1.

Second Embodiment

Figure 4:
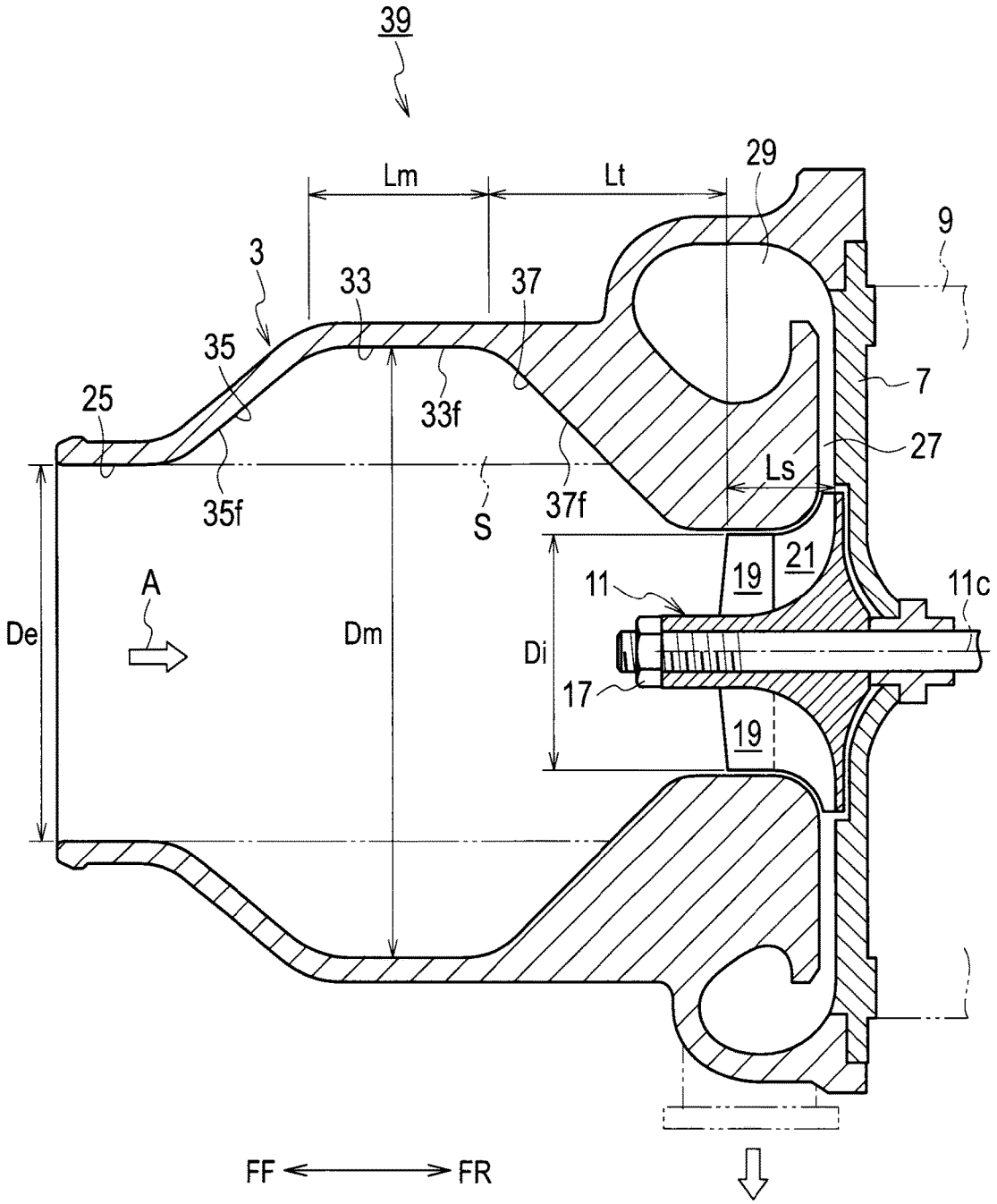
FIG. 4 is a cross-sectional view of a centrifugal compressor of a second embodiment of the present invention.

Descriptions will be provided for a second embodiment of the present invention while referring to FIG. 4. In the drawing, reference sign "FF" denotes the forward direction, and reference sign "FR" denotes the rearward diction.

As shown in FIG. 4, a centrifugal compressor 39 of a second embodiment of the present invention is configured to compress air A with centrifugal force, and has a configuration similar to that of the centrifugal compressor 1 of the first embodiment. Accordingly, as in the case of the first embodiment, the centrifugal compressor 39 is used for a vehicle turbocharger, a gas turbine, an industrial pneumatic system, and the like. The following descriptions will be provided only for different portions in the configuration of the centrifugal compressor 39 from those in the configuration of the centrifugal compressor 1. Of the multiple components of the centrifugal compressor 39, those corresponding to their counterparts in the centrifugal compressor 1 will be denoted by the same reference signs in the drawing.

The cylindrical casing 23 is omitted in the centrifugal compressor 39 of the second embodiment. Accordingly, the suction opening 25 is formed, upstream of the inlet of the impeller 11, in the outer surface of the housing 3 (on the front side of the outer wall of the housing 3). As a result, the expanded section 33 is formed between the suction opening 25 and the impeller 11 in the housing 3. As in the case of the first embodiment, the inlet tapered section 35 is formed on the inlet side (immediately upstream side) of the expanded section 33 in the housing 3 in a way that the inlet tapered section 35 continues to the inlet thereof. The outlet tapered section 37 is formed on the outlet side (immediately downstream side) of the expanded section 33 in the housing 3 in a way that the outlet tapered section 37 continues to the outlet thereof.

In the second embodiment, the inner diameter Dm of the expanded section 33 is set at a value which is larger than the inner diameter De of the suction opening 25 and 2.0 to 4.0 times as large as the inlet diameter Di of the impeller 11, as in the case of the first embodiment. The ratio (Lt/Ls) is set in a range of 1.0 to 6.0, or preferably in a range of 1.5 to 4.0. As described above, reference sign Ls denotes the axial length of each blade 19, while reference sign Lt denotes the distance from the front edge 19*a* of each blade 19 to the expanded section 33 in the axial direction B1 of the impeller 11. Furthermore, the ratio (Lm/Ls) of the axial length Lm of the expanded section 33 to the axial length Ls of each blade 19 is set in a range of 0.5 to 5.0, or preferably in a range of 0.5 to 2.5.

This embodiment brings about the same working and effects as does the first embodiment of the present invention. In addition, in this embodiment, the suction opening 25, the expanded section 33, the inlet tapered section 35 and the outlet tapered section 37 are formed in the housing 3. For this reason, this embodiment is capable of sufficiently suppressing an increase in size of the centrifugal compressor 1, and of realizing the more compact centrifugal compressor 1.

It should be noted that: the present invention is not limited to what have been described for the foregoing embodiments; and the present invention can be carried out in various modes by modifying the present invention as needed. Furthermore, the scope of right encompassed by the present invention is not limited only to these embodiments.

EXAMPLE

Descriptions will be provided for an example of the present invention.

The centrifugal compressor 1 of the first embodiment of the present invention was made as a prototype, while a centrifugal compressor obtained by excluding the casing 23 from the centrifugal compressor 1 was made as a comparative product. Performances of the prototype and the comparative product were tested while simulating actual operational conditions. The result of the test confirmed that the amount of surge in the prototype was successfully reduced by 15% compared with the amount of surge in the comparative product.

What is claimed is:

1. A centrifugal compressor configured to compress a gas with centrifugal force, comprising:

a housing;

an impeller rotatably provided in the housing, the impeller including, a disc rotatable about an axis of the impeller, and a plurality of blades provided on an outer peripheral surface of the disc at intervals in a circumferential direction of the disc;

a suction opening formed on an inlet side of the impeller and configured to suck the gas; and an expanded section formed between the suction opening and the impeller, and defining a cylindrical space, wherein the expanded section has an inner diameter which is larger than an inner diameter of the suction opening and 2 to 4 times as large as an inlet diameter of the impeller, and a whole of the expanded section is positioned closer to the suction opening than leading edges of the blades.

2. The centrifugal compressor according to claim 1, wherein a ratio of a distance from the leading edge of each blade to the expanded section in the axial direction to an axial length of the blade is in a range of 1.0 to 6.0.

3. The centrifugal compressor according to claim 2, wherein a ratio of an axial length of the expanded section to an axial length of each blade is in a range of 0.5 to 5.0.

4. The centrifugal compressor according to claim 3, wherein an inlet tapered section whose inner diameter becomes gradually smaller toward its upstream end is formed on an inlet side of the expanded section, and an outlet tapered section whose inner diameter becomes gradually smaller toward its downstream end is formed on an outlet side of the expanded section.

5. The centrifugal compressor according to claim 4, comprising a cylindrical casing which is provided, upstream of an inlet of the impeller, to an outer wall of the housing in a way that the casing communicates with the inlet of the impeller, wherein the suction opening is formed on a front end side of the casing, the expanded section is formed in the casing, the inlet tapered section is formed on the inlet side of the expanded section in the casing, and the outlet tapered section is formed on the outlet side of the expanded section in the casing.

6. The centrifugal compressor according to claim 4, wherein the suction opening is formed, upstream of an inlet of the impeller, in an outer wall of the housing, the expanded section is formed between the suction opening and the impeller in the housing, the inlet tapered section is formed on the inlet side of the expanded section in the housing, and the outlet tapered section is formed on the outlet side of the expanded section in the housing.

7. The centrifugal compressor according to claim 2, wherein an inlet tapered section whose inner diameter becomes gradually smaller toward its upstream end is formed on an inlet side of the expanded section, and an outlet tapered section whose inner diameter becomes gradually smaller toward its downstream end is formed on an outlet side of the expanded section.

8. The centrifugal compressor according to claim 7, comprising a cylindrical casing which is provided, upstream of an inlet of the impeller, to an outer wall of the housing in a way that the casing communicates with the inlet of the impeller, wherein the suction opening is formed on a front end side of the casing, the expanded section is formed in the casing, the inlet tapered section is formed on the inlet side of the expanded section in the casing, and the outlet tapered section is formed on the outlet side of the expanded section in the casing.

9. The centrifugal compressor according to claim 7, wherein the suction opening is formed, upstream of an inlet of the impeller, in an outer wall of the housing, the expanded section is formed between the suction opening and the impeller in the housing, the inlet tapered section is formed on the inlet side of the expanded section in the housing, and the outlet tapered section is formed on the outlet side of the expanded section in the housing.

10. The centrifugal compressor according to claim 1, wherein a ratio of an axial length of the expanded section to an axial length of each blade is in a range of 0.5 to 5.0.

11. The centrifugal compressor according to claim 10, wherein an inlet tapered section whose inner diameter becomes gradually smaller toward its upstream end is formed on an inlet side of the expanded section, and an outlet tapered section whose inner diameter becomes gradually smaller toward its downstream end is formed on an outlet side of the expanded section.

12. The centrifugal compressor according to claim 11, comprising a cylindrical casing which is provided, upstream of an inlet of the impeller, to an outer wall of the housing in a way that the casing communicates with the inlet of the impeller, wherein the suction opening is formed on a front end side of the casing, the expanded section is formed in the casing, the inlet tapered section is formed on the inlet side of the expanded section in the casing, and the outlet tapered section is formed on the outlet side of the expanded section in the casing.

13. The centrifugal compressor according to claim 11, wherein the suction opening is formed, upstream of an inlet of the impeller, in an outer wall of the housing, the expanded section is formed between the suction opening and the impeller in the housing, the inlet tapered section is formed on the inlet side of the expanded section in the housing, and the outlet tapered section is formed on the outlet side of the expanded section in the housing.

14. The centrifugal compressor according to claim 1, wherein an inlet tapered section whose inner diameter becomes gradually smaller toward its upstream end is formed on an inlet side of the expanded section, and an outlet tapered section whose inner diameter becomes gradually smaller toward its downstream end is formed on an outlet side of the expanded section.

15. The centrifugal compressor according to claim 14, comprising a cylindrical casing which is provided, upstream of an inlet of the impeller, to an outer wall of the housing in a way that the casing communicates with the inlet of the impeller, wherein the suction opening is formed on a front end side of the casing, the expanded section is formed in the casing, the inlet tapered section is formed on the inlet side of the expanded section in the casing, and the outlet tapered section is formed on the outlet side of the expanded section in the casing.

16. The centrifugal compressor according to claim 14, wherein the suction opening is formed, upstream of an inlet of the impeller, in an outer wall of the housing, the expanded section is formed between the suction opening and the impeller in the housing, the inlet tapered section is formed on the inlet side of the expanded section in the housing, and the outlet tapered section is formed on the outlet side of the expanded section in the housing.

* * * * *